United States Patent [19]

Christensen

[11] Patent Number: 4,668,322

[45] Date of Patent: May 26, 1987

[54] METHOD AND AN APPARATUS FOR EMBOSSING A DRY LAID FIBRE WEB, E.G. FOR KITCHEN ROLL PAPER

[75] Inventor: John M. Christensen, Risskov, Denmark

[73] Assignee: Scan-Web I/S, Risskov, Denmark

[21] Appl. No.: 798,692

[22] PCT Filed: Feb. 27, 1985

[86] PCT No.: PCT/DK85/00017

§ 371 Date: Oct. 28, 1985

§ 102(e) Date: Oct. 28, 1985

[87] PCT Pub. No.: WO85/03962

PCT Pub. Date: Sep. 12, 1985

[30] Foreign Application Priority Data

Feb. 28, 1984 [DK] Denmark ..... 1112/84

[51] Int. Cl.[4] ..... D04H 1/44; D04H 1/58

[52] U.S. Cl. ..... 756/209; 19/296; 425/83.1

[58] Field of Search ..... 425/80.1, 83.1; 264/121, 119; 19/296; 156/209, 296

[56] References Cited

U.S. PATENT DOCUMENTS 4,375,448 3/1983 App et al. ..... 264/121

4,417,931 11/1983 Li ..... 264/121

*Primary Examiner*—Michael Ball

*Attorney, Agent, or Firm*—Antonelli, Terry & Wands

[57] ABSTRACT

A desirable embossing of a fibrous web (6) as dry laid on a forming sheet (2) is effected by the web (6) in a still unglued condition passing a pair of embossing producing rollers (18, 20) carried on or by a pressure resistant support sheet (16) as also passing between the rollers. Problems as to web fractures are hereby widely eliminated.

2 Claims, 2 Drawing Figures

METHOD AND AN APPARATUS FOR EMBOSSING A DRY LAID FIBRE WEB, E.G. FOR KITCHEN ROLL PAPER

A method and an apparatus for embossing a dry laid fibre web, e.g. for kitchen roll paper.

The invention relates to a method and an apparatus for dry forming of porous paper and corresponding products of dry laid fibres, which are laid out as a layer on a moved forming sheet and are further conveyed as a web, which is treated with glue and passes an embossing station, in which the web is successively forced against an embosser roller providing an embossed pattern in the web. The embossed pattern may give the web, e.g. kitchen roll paper, an attractive appearance, but its main purpose is to give strength to the web, the web material in this lines or spots of the embossed pattern being compacted for an increased bond between the fibres, while the web areas between these lines or spots maintain their character of a voluminous, porous material.

The embossing station consists of a pair of rotating rollers, between which the web is moved in a free run between a preceding and subsequent conveyor sheet. The embossing is more effective when carried out on the web prior to the glueing thereof, but before the glueing the coherence of the web is so low that web fractures occur frequently when the production speed is reasonably high, even though care is taken to reduce as much as possible the length of the free carried web lengths in front of and behind the rollers. These lengths would be more robust if the web was glued prior to the embossing, but this, in turn, would give rise to other and rather difficult problems.

It is the object of the invention to provide a method, whereby the fibrous web may be effectively embossed in its unglued condition in a very advantageous manner.

The invention has its starting point in the idea that the embossing should not necessarily be effected on a freely carried length of the web, as the web could well, during its passage of the embossing station, be supported by a support sheet, provided the latter is robust enough to resist the working pressure between the rollers. In practice the support sheet shall be a perforated sheet, through which air can be sucked for holding the unglued fibre material against the sheet during the rapid movement thereof. Principally the said forming sheet could be usable for carrying the web through the embosser rollers, but conventional forming sheets would hardly resist the desired embossing pressure, even though it has been found that this pressure can be considerably smaller than the pressure as conventionally used for the embossing of glued webs. The forming sheet of a production plant is relatively long, and it would be correspondingly very expensive if it had to be of a particular pressure resistent type.

The invention is further based on the recognition that the said support sheet may well consist of a separate and rather short, endless belt, which can be adapted particularly for the relevant purpose, this sheet being arranged so as to successively receive the unglued material web from the forming sheet and bring the web through the pair of embossing rollers for rapidly thereafter bringing the web further to a following conveyor sheet, which will bring the web through one or more glueing stations and, when applicable, further treating stations, before the final delivery of the web, e.g. to a station for reeling up the finished web.

In practice it will be sufficient that the special support sheet is guided or moved through a closed path, which surrounds either the embosser roller or—preferably—the counter pressure roller thereof, and which extends partly overlapping a delivery end of the forming sheet and a receiver end of the following conveyor sheet, respectively. Thus, the special support sheet may run through a rather small loop, at the inside of which the required means for providing a suction through the perforated support sheet may be arranged, such that the sheet may temporarily hold the unglued web of fibre material during its passage through the embosser station.

Thus, the special support sheet may be of a short length, whereby it is of minor importance whether the sheet is considerably more expensive than the forming sheet. The support sheet, by way of example, may be of a net belt of steel or hard plastic.

The invention, which is more specifically defined in the claims, will now be described in more detail with reference to the drawing, in which:

Figure 1:
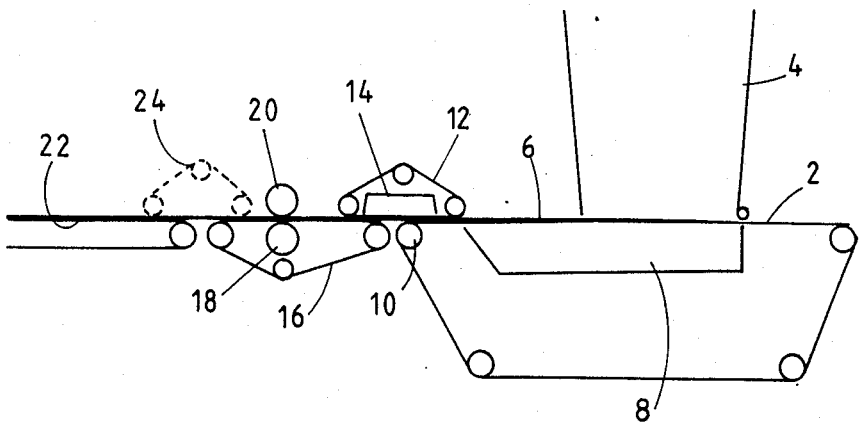
FIG. 1 is a schematic side view of a system according to the invention.

In FIG. 1 is shown an endless, perforated forming sheet, an upper run of which is moved past the lower end of a distributor unit 4, which in a known manner supplies an even flow of dry fibres to the sheet 2, such that a layer or web 6 of fibre material is built up thereon. The fibres are sucked down onto the sheet by means of a suction box 8 underneath the sheet. The suction box 8 may be prolonged in the moving direction of the sheet, such that the formed web 6 can be held to the sheet during the further high speed conveying thereof.

The forming sheet passes around a front reversing roller 10, but prior to that the web 6 passes under an upper transfer sheet belt 12 as moving in a loop around a downwardly open suction box 14, whereby the web 6 will be sucked against the underside of the sheet 12 and thus moved away from the forming sheet 2.

The transfer sheet 12 conveyes the web 6 to a following conveyor belt sheet 16 as running in a narrow loop about a roller 18; above the sheet 16 is mounted an embosser roller 20, such that the web 6 on the sheet 16 is now moved under the embosser roller as operating with or against a counter pressure from the roller 18 through the sheet 16.

Thereafter the embossed web is transferred to a following conveyor belt 22, either in a freely carried manner or by means of an additional transfer sheet 24 as shown in dotted lines, whereafter the web is moved further to a glueing station and further treatment.

The sheet 16, of course, should be adapted to be able to resist the high embossing pressure. It may even, itself, be structured for active underside embossing of the web. Hereby it may even be the sheet 16, which constitutes the embossing tool, while both the rollers 18 and 20 are smooth.

Principally the invention will comprise the cooperation of the rollers 18 and 20 direct with a prolonged delivery end of the forming sheet 2 itself, though this will normally require the long forming sheet to be of a particularly pressure resistant quality, whereby the entire sheet will be very expensive.

Figure 2:
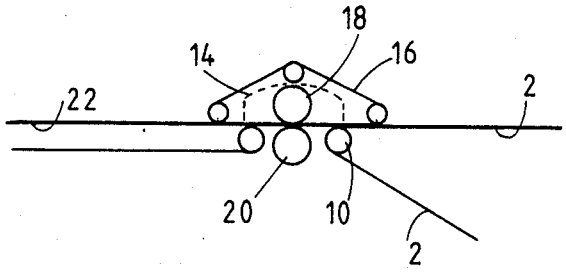
FIG. 2 is a corresponding view of a modified embodiment thereof.

In the embodiment shown in FIG. 2 the pressure resistant sheet 16 is arranged as a transfer belt direct between the forming sheet 2 and the delivery belt 22, such that the embosser roller 20 works on the underside of the web 6.

When the embossing is effected on the unglued web no or no substantial heating of the embosser roller will be required, and the deformation problems as otherwise connected with the use of long, heated rollers will thus be avoided.

I claim:

1. A method of embossing a dry formed fibre web such as kitchen roll paper with the use of a pair of embossing producing rollers, characterized in that the fibre web, immediately upon the dry forming thereof and prior to a following glueing treatment of the web, is move through said pair of embossing producing rollers together with a web supporting carrier sheet, and, upon the fibre web being dry formed on a forming sheet, the fibre web is transferred to a separate, pressure resistant support sheet, which runs through said pair of embossing producing rollers in an endless short loop, and in that the web, upon passing the pair of embossing producing rollers, is transferred to a separate following conveyor belt.

2. An apparatus for carrying out the method claimed in claim 1, the apparatus comprising a movable forming sheet for receiving a web of fibrous material from a fibre distributor unit and a pair of embossing producing rollers for embossing the web as delivered from the distributor unit, characterized in that the said pair of embossing producing rollers cooperate with an endless support belt sheet as carrying the web through the pair of embossing producing rollers, and in that at the delivery end of the forming sheet an overlying transfer conveyor belt is arranged for controlled transfer of the web to a following support belt section in which a pressure resistant support belt brings the web through the pair of embossing producing rollers.

* * * * *